US012680768B2

(12) United States Patent
Song et al.

(10) Patent No.: US 12,680,768 B2
(45) Date of Patent: Jul. 14, 2026

(54) ONE-WAY DIVERTING DEVICE AND VARIABLE DIVERTING HEAT EXCHANGER

(71) Applicants: HAIER SHENZHEN RESEARCH AND DEVELOPMENT CO. LTD, Shenzhen (CN); HAIER SMART HOME CO., LTD, Qingdao (CN)

(72) Inventors: Yujun Song, Qingdao (CN); Chunfeng Lao, Qingdao (CN); Fei Wang, Qingdao (CN); Defang Guo, Qingdao (CN); Mingjie Zhang, Qingdao (CN); Long Zhang, Qingdao (CN); Shuang Ding, Qingdao (CN); Xinyi Zhang, Qingdao (CN); Wenming Xu, Qingdao (CN); Wenjuan Cui, Qingdao (CN); Yang Li, Qingdao (CN)

(73) Assignees: HAIER SHENZHEN RESEARCH AND DEVELOPMENT CO. LTD, Shenzhen (CN); HAIER SMART HOME CO., LTD, Qingdao (CN)

( * ) Notice: Subject to any disclaimer, the term of this patent is extended or adjusted under 35 U.S.C. 154(b) by 122 days.

(21) Appl. No.: 18/864,715

(22) PCT Filed: Dec. 15, 2022

(86) PCT No.: PCT/CN2022/139342

§ 371 (c)(1),
(2) Date: Nov. 11, 2024

(87) PCT Pub. No.: WO2023/221490

PCT Pub. Date: Nov. 23, 2023

(65) Prior Publication Data

US 2025/0341370 A1 Nov. 6, 2025

(30) Foreign Application Priority Data

May 20, 2022 (CN) ..... 202210547991.X

(51) Int. Cl.
*F28F 27/02* (2006.01)

(52) U.S. Cl.
CPC ..... *F28F 27/02* (2013.01)

(58) Field of Classification Search
CPC .... F28F 27/02; F28F 2250/00; F28F 2250/06; F25B 41/26; F25B 2313/0272
See application file for complete search history.

(56) References Cited

U.S. PATENT DOCUMENTS 4,240,469 A * 12/1980 Bauer ..... F16K 27/041 137/625.25
4,255,939 A * 3/1981 Ou ..... F25B 41/26 137/625.29

(Continued)

FOREIGN PATENT DOCUMENTS

CN 109963733 A 7/2019
CN 113710940 A 11/2021

(Continued)

OTHER PUBLICATIONS

European Search Report issued in counterpart European Patent Application No. EP 22942510.3, dated Oct. 15, 2025.

(Continued)

*Primary Examiner* — Travis Ruby
(74) *Attorney, Agent, or Firm* — Westbridge IP LLC

(57) ABSTRACT

A one-way diverting device includes a main pipe, a branch pipe, a connecting branch pipe, and a first sliding blocking member. The main pipe includes the first refrigerant pipe opening and the second refrigerant pipe opening disposed on the two ends of the main pipe respectively, wherein the main pipe is provided with a first distributing position close to the first refrigerant pipe opening and a second distributing position close to the second refrigerant pipe opening. One end of the branch pipe is connected to the first distributing position of the main pipe, and the other end of the branch (Continued)

pipe is a third refrigerant pipe opening. The connecting branch pipe connects the second distributing position of the main pipe and the branch pipe. The first sliding blocking member is slidably disposed at the first distributing position.

20 Claims, 9 Drawing Sheets

(56) References Cited

U.S. PATENT DOCUMENTS

| | | | | |
|---|---|---|---|---|
| 4,292,720 | A * | 10/1981 | Bauer | F16K 27/041 29/890.122 |
| 2019/0255907 | A1* | 8/2019 | Kozasa | F28F 9/0202 |
| 2022/0034562 | A1* | 2/2022 | Makihara | F25B 25/005 |

FOREIGN PATENT DOCUMENTS

| | | | |
|---|---|---|---|
| CN | 113865156 | A | 12/2021 |
| CN | 114688771 | A | 7/2022 |
| EP | 0967446 | A2 | 12/1999 |
| EP | 1892132 | B1 | 5/2012 |
| JP | 2000161808 | A | 6/2000 |

OTHER PUBLICATIONS

Notice of Reasons for Refusal issued in counterpart Japanese Patent Application No. 2024-566685, dated Dec. 2, 2025.
International Search Report issued in corresponding PCT Application No. PCT/CN2022/139342, dated Mar. 9, 2023.

* cited by examiner

D

ONE-WAY DIVERTING DEVICE AND VARIABLE DIVERTING HEAT EXCHANGER

CROSS-REFERENCE OF RELATED APPLICATIONS

This application is the National Stage of International Application No. PCT/CN2022/139342, filed on Dec. 15, 2022, which claims priority to Chinese Patent Application No. CN202210547991.X, filed on May 20, 2022. All of the aforementioned applications are incorporated herein by reference in their entireties.

TECHNICAL FIELD

The present disclosure relates to the technical field of air conditioners, and more particularly to a one-way diverting device and a variable diverting heat exchanger.

BACKGROUND

The optimal flow paths are different when the air conditioner is in the cooling operation and the heating operation.

In a case where an air conditioner is in the heating operation, a refrigerant of the heat exchange pipe of the outdoor heat exchanger is in a low-temperature and low-pressure condition, and the heat transfer performance is mainly affected by the heat transfer coefficient and the pressure drop together, which is suitable for a relatively large number of branches, and ensuring the heat transfer coefficient, the system pressure is increased by greatly reducing the pressure drop, thus improving the low-temperature heat production of the air conditioner. In a case where an air conditioner is in the cooling operation, a refrigerant of the heat exchange pipe of the outdoor heat exchanger is in a high-temperature and high-pressure condition, and the heat transfer performance is mainly affected by the heat transfer coefficient and is insensitive to the pressure drop, which is suitable for fewer branches to accelerate circulation and increase the heat transfer coefficient, thus improving the high-temperature cool production of the air conditioner. The conventional outdoor heat exchangers of the air conditioner mainly adopt variable diverting heat exchangers to control the transition of the above refrigerant flow paths between the heating operation and the cooling operation.

During the implementation of the embodiment of the present disclosure, at least the following problems have been found in the related arts.

The above variable diverting heat exchangers usually adopt one-way valves, solenoid valves, and other valves to realize the transition control of the refrigerant flow paths between the heating operation and the cooling operation. The increase of one-way valves, solenoid valves, and other valves often leads to the increase of solder points of the variable diverting heat exchanger. To ensure the safety distance of the solder, it is necessary to keep the solder safety distance more than 30 mm between the solder points, thus the material cost and the space cost of the variable diverting heat exchanger are increased.

SUMMARY

In order to have a basic understanding of some aspects of the disclosed embodiments, a brief summary is given below. The summary is not intended to be a general comment to identify crucial/essential constituent elements or to describe the protection scope of these embodiments but rather to serve as a preface to the detailed description that follows.

A one-way diverting device and a variable diverting heat exchanger are provided according to the embodiment of the present disclosure to solve the problem of the increase of material cost and space cost in a variable diverting heat exchanger due to the increase of solder points.

According to a first aspect of the embodiments of the present disclosure, a one-way diverting device is provided and comprises: a main pipe, comprising a first refrigerant pipe opening and a second refrigerant pipe opening disposed at two ends of the main pipe, respectively, where the main pipe is provided with a first distributing position close to the first refrigerant pipe opening and a second distributing position close to the second refrigerant pipe opening; a branch pipe, where one end of the branch pipe is connected to the first distributing position of the main pipe, and the other end of the branch pipe is a third refrigerant pipe opening; a connecting branch pipe, connecting the second distributing position of the main pipe to the branch pipe; and a first sliding blocking member, slidably disposed the first distributing position; where in a case where the first sliding blocking member slides to a first position, the first refrigerant pipe opening is blocked, and the refrigerant flows in from the second refrigerant pipe opening and flows out from the third refrigerant pipe opening; and in a case where the first sliding blocking member slides to a second position, the first refrigerant pipe opening is conducted, and the refrigerant flows in from the first refrigerant pipe opening, and flows out from the second refrigerant pipe opening and the third refrigerant pipe opening.

In some embodiments, the first sliding blocking member comprises: a first blocking slider, disposed along a cross-section of the first distributing position of the main pipe, and slidable between the first position of the first distributing position and the second position of the first distributing position; a first abutting slider, fixedly connected to the first blocking slider and abuts against an inner side wall of the main pipe; where the first abutting slider is slidable along with the first blocking slider, a first locating member, disposed at the inner side wall of the main pipe, in a case where the first sliding blocking member slides to the first position, the first blocking slider abuts against the first locating member; and a second locating member, disposed at the inner side wall of the main pipe; and in a case where the first sliding blocking member slides to the second position, the first abutting slider buts against the second locating member.

In some embodiments, an inside of the first blocking slider is hollow or partly hollow.

In some embodiments, the first blocking slider comprises: a first bottom surface, facing the inside of the main pipe; a second bottom surface, facing the first refrigerant pipe opening; and a first side surface, disposed surrounding between the first bottom surface and the second bottom surface, where the first abutting slider is disposed along a periphery of the first bottom surface, a perimeter of the first bottom surface has a first length, and an extended length of the first abutting slider in the first bottom surface has a second length, where the second length is longer than or equal to ⅓ of the first length and shorter than or equal to ½ of the first length.

In some embodiments, a distance between the first side surface of the first blocking slider and the inner side wall of the main pipe at the first distributing position is larger than or equal to 0.005 mm, and smaller than or equal to 1 mm.

In some embodiments, the cross-section of the first distributing position of the main pipe is a polygon, and the first blocking slider is shaped as same as the cross-section of the first distributing position.

In some embodiments, the first bottom surface of the first blocking slider comprises a first edge and a second edge bending connected; where the first abutting slider comprises a first abutting plate and a second abutting plate bending connected, the first abutting plate is fixedly connected to the first abutting plate and the second abutting plate is fixedly connected to the second edge.

In some embodiments, the first sliding blocking member further comprises a first protrusion, the first protrusion is disposed at the first side surface of the first blocking slider, and a height of the first protrusion is less than or equal to a height of the first side surface; where the first protrusion is disposed at a side of the first sliding blocking member facing the first distributing position, and the first abutting slider is disposed at a side of the first sliding blocking member away from the first distributing position.

In some embodiments, the main pipe comprises a first pipe section between the first refrigerant pipe opening and the first distributing position, where the first pipe section is inclinedly disposed facing the side of the first distributing position.

According to a second aspect of the embodiments of the present disclosure, a one-way diverting device is provided and comprises: a main pipe, comprising a first refrigerant pipe opening and a second refrigerant pipe opening at two ends of the main pipe, respectively, and the main pipe is provided with a first distributing position close to the first refrigerant pipe opening and a second distributing position close to the second refrigerant pipe opening; a branch pipe, one end of the branch pipe is connected to the first distributing position of the main pipe, and the other end of the branch pipe is the third refrigerant pipe opening; a connecting branch pipe, connecting the second distributing position of the main pipe to the branch pipe; and a second sliding blocking member, slidably disposed at the second distributing position, in a case where the second sliding blocking member slides to a third position, the second refrigerant pipe opening is blocked, and the refrigerant flows in from the first refrigerant pipe opening and flows out from the third refrigerant pipe opening; in a case where the second sliding blocking member slides to a fourth position, the second refrigerant pipe opening is conducted, and the refrigerant flows in from the second refrigerant pipe opening and the third refrigerant pipe opening, and flows out from the first refrigerant pipe opening.

In some embodiments, the second sliding blocking member comprises: a second blocking slider, disposed along a cross-section of the second distributing position of the main pipe, and is slidable between the third position of the second distributing position and the fourth position of the second distributing position, a second abutting slider, fixedly connected to the second blocking slider and abuts against the inner side wall of the main pipe, and the second abutting slider is slidable along with the second blocking slider; a third locating member, disposed at an inner side wall of the main pipe, in a case where the second sliding blocking member slides to the third position, the second blocking slider abuts against the third locating member; and a fourth locating member, disposed at the inner side wall of the main pipe; in a case where the second sliding blocking member slides to the fourth position, the second abutting slider buts against the fourth locating member.

In some embodiments, an inside of the second blocking slider is hollow or partly hollow.

In some embodiments, the second blocking slider comprises: a third bottom surface, facing the inside of the main pipe; a fourth bottom surface, facing the second refrigerant pipe opening; and a second side surface, disposed surrounded between the third side surface and the fourth bottom surface, where the second abutting slider is disposed along a periphery of the third bottom surface, a perimeter of the third bottom surface has a third length, and an extended length of the second abutting slider in the third bottom surface ha a fourth length, where the fourth length is longer than or equal to ⅓ of the third length, and shorter than or equal to ½ of the third length.

In some embodiments, the distance between the second side surface of the second blocking slider and the inner side wall of the main pipe at the second distributing position is larger than or equal to 0.005 mm, and smaller than or equal to 1 mm.

In some embodiments, a cross-section of the second distributing position of the main pipe is a polygon, and the second blocking slider is shaped as same as the cross-section at the second distributing position.

In some embodiments, the third bottom surface of the second blocking slider comprises a third edge and a fourth edge bending connected, where a second abutting slider comprises a third abutting plate and a fourth abutting plate bending connected, the third abutting plate is fixedly connected to the third abutting plate, and the fourth abutting plate is fixedly connected to the fourth edge.

In some embodiments, the second sliding blocking member further comprises a second protrusion, disposed at the second side surface of the second blocking slider, and a height of the second protrusion is less than or equal to a height of the second side surface, where the second protrusion is disposed at a side of the second sliding blocking member facing the second distributing position, and the second abutting slider is disposed at a side of the second sliding blocking member away from the second distributing position.

In some embodiments, a main pipe comprises a second pipe section between the second refrigerant pipe opening and the second distributing position, where the second pipe section is inclinedly disposed facing the second distributing position.

According to a third aspect of the embodiments of the embodiment, a variable diverting heat exchanger is provided and comprises: a heat exchange pipe, comprising a first heat exchange branch, a second heat exchange branch, and a third heat exchange branch connected in parallel; a first one-way diverting device, disposed at the first side of the heat exchange pipe, where a second refrigerant pipe opening of the first one-way diverting device is connected to the first heat exchange branch; a first distributor, disposed at the second side of the heat exchange pipe, where the first distributor is connected to the second heat exchange branch and the third heat exchange branch; a second one-way diverting device, disposed at the second side of the heat exchange pipe, where a third refrigerant pipe opening of the second one-way diverting device is connected to the first heat exchange branch; a first bypass pipe, connecting the second refrigerant pipe opening of the second one-way diverting device with the first distributor; a second distributor, disposed at the first side of the heat exchange pipe, where the second distributor is connected to the third heat exchange pipe; and a second bypass pipe, connecting a first refrigerant pipe opening of the first one-way diverting device and the second distributor, where the first one-way diverting device is a one-way diverting device according to any one of the first aspects of the embodiments, and the second one-way diverting device is a one-way diverting device according to any one of the second aspect of the embodiments.

The one-way diverting device and the variable diverting heat exchanger provided by the embodiment of the present disclosure can have the following technical advantages:

The variable diverting heat exchanger provided by the embodiment of the present disclosure comprises a heat exchange pipe, a first distributor, a second distributor, a first bypass pipe, a second bypass pipe, a first one-way diverting device, and a second one-way diverting device. The first one-way diverting device and a second one-way diverting device both comprise a main pipe, a branch pipe, and a connecting branch pipe, where a first refrigerant pipe opening and a second refrigerant pipe opening are disposed at the two ends of the main pipe respectively, a first distributing position is disposed at the main pipe close to the first refrigerant pipe opening, and a second distributing position is disposed at the main pipe close to the second refrigerant pipe opening. One end of the branch pipe is connected to the first distributing position; the other end of the branch pipe is the third refrigerant pipe opening. The connecting branch pipe connects the second distributing position and the branch pipe.

The first one-way diverting device further comprises a first sliding blocking member, the first sliding blocking member is disposed at the first distributing position. In a case where the first sliding blocking member slides to the first position, the first refrigerant pipe opening is blocked, and the refrigerant flows in from the second refrigerant pipe opening, and flows out from the third refrigerant pipe opening. In a case where the first sliding blocking member slides to the second position, the first refrigerant pipe opening is conducted, and the refrigerant flows in from the first refrigerant pipe opening and flows out from the second refrigerant pipe opening and the third refrigerant pipe opening. The first one-way diverting device doesn't need to be provided with redundant valves, the flow direction of the refrigerant inside the first one-way diverting device can be changed by blocking or conducting the first refrigerant pipe opening by the first sliding blocking member, reducing the material cost and the space cost.

The second one-way diverting device further comprises a second sliding blocking member, the second sliding blocking member is disposed at the second distributing position. In a case where the second sliding blocking member slides to the third position, the second refrigerant pipe opening is blocked, and the refrigerant flows in from the first refrigerant pipe opening, and flows out from the third refrigerant pipe opening. In a case where the second sliding blocking member slides to the fourth position, the second refrigerant pipe opening is conducted, and the refrigerant flows in from the second refrigerant pipe opening and the third refrigerant pipe opening, and flows out from the first refrigerant pipe opening. The second one-way diverting device doesn't need to be provided with redundant valves, the flow direction of the refrigerant inside the second one-way diverting device can be changed by blocking or conducting the second refrigerant pipe opening by the second sliding blocking member, reducing the material cost and the space cost.

The above general description and the description below are exemplary and explanatory only and are not intended to limit the present disclosure.

BRIEF DESCRIPTION OF THE DRAWINGS

One or more embodiments are illustrated by means of the corresponding drawings, which do not constitute a limitation of the embodiments, elements having the same reference numerals in the drawings are shown as similar elements, and the drawings do not constitute a limitation of proportion.

DETAILED DESCRIPTION OF THE EMBODIMENTS

In order to enable a more detailed understanding of the features and technical content of the embodiments of the present disclosure, the implementation of the embodiments of the present disclosure will be described in detail below in conjunction with the accompanying drawings, which are for illustration only and are not intended to limit the embodiments of the present disclosure. In the following technical description for convenience of explanation, several details are provided for a full understanding of the disclosed embodiments. However, one or more embodiments may still be practiced without these details. In other instances, the well-known structures and devices may simplify the disclosure in order to simplify the drawings.

The terms "first", "second" and the like in the specification and claims of embodiments of the present disclosure and the above drawings are used to distinguish similar elements and are not necessarily used to describe a particular order or priority. It should be understood that the data used in this way can be interchanged where appropriate for the embodiments of the present disclosure described herein. Furthermore, the terms "include" and "have" and any variations thereof are intended to cover a non-exclusive inclusion.

In embodiments of the present disclosure, directional or positional relationships indicated by terms such as "up", "down", "on", "in", "interior", "out", "front" and "rear" is based on the directional or positional relationship shown in the figures. These terms are mainly intended to describe embodiments of the present disclosure, not to limit that the described devices, elements or components must have a specific orientation or be configured and operated in a specific orientation. Furthermore, in addition to indicating the directional or positional relationship, the above partial terms might also be used to convey other meanings, for example, the term "on" might also be used to indicate a dependency relationship or connectional relationship in some cases. Those having ordinary skills in the art may understand specific meanings of these terms in the embodiments of the present disclosure according to specific situations.

In addition, the terms "dispose", "connect" and "fix" should be understood in a broad sense. For example, "connect" may be a fixed connection, detachable connection or integral connection, may be mechanical connection or electrical connection, may be direct connection, or indirect connection through an intermediate medium, or may be internal communication between two devices, elements or components. Those having ordinary skills in the art may understand specific meanings of the above terms in the embodiments of the present disclosure according to specific situations.

Unless otherwise illustrated, the term "a plurality of" means two or more.

Embodiments of the present disclosure and features in the embodiments may be combined with one another without conflict.

Figure 1:
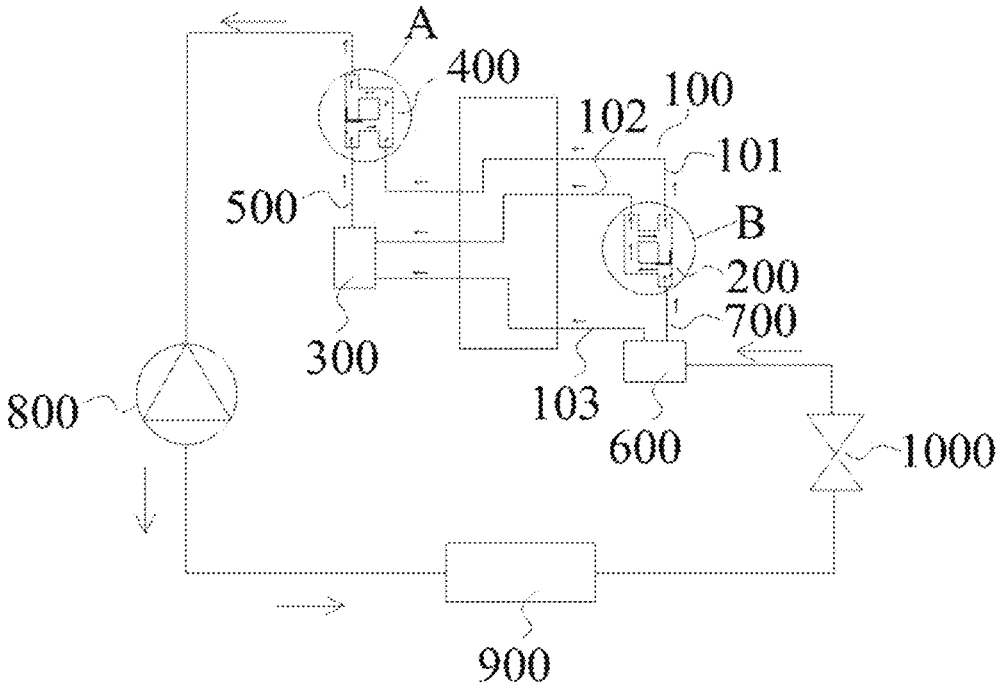
FIG. 1 is a schematic structure diagram of a variable diverting heat exchanger in the heating operation according to an embodiment of the present disclosure.
Figure 3:
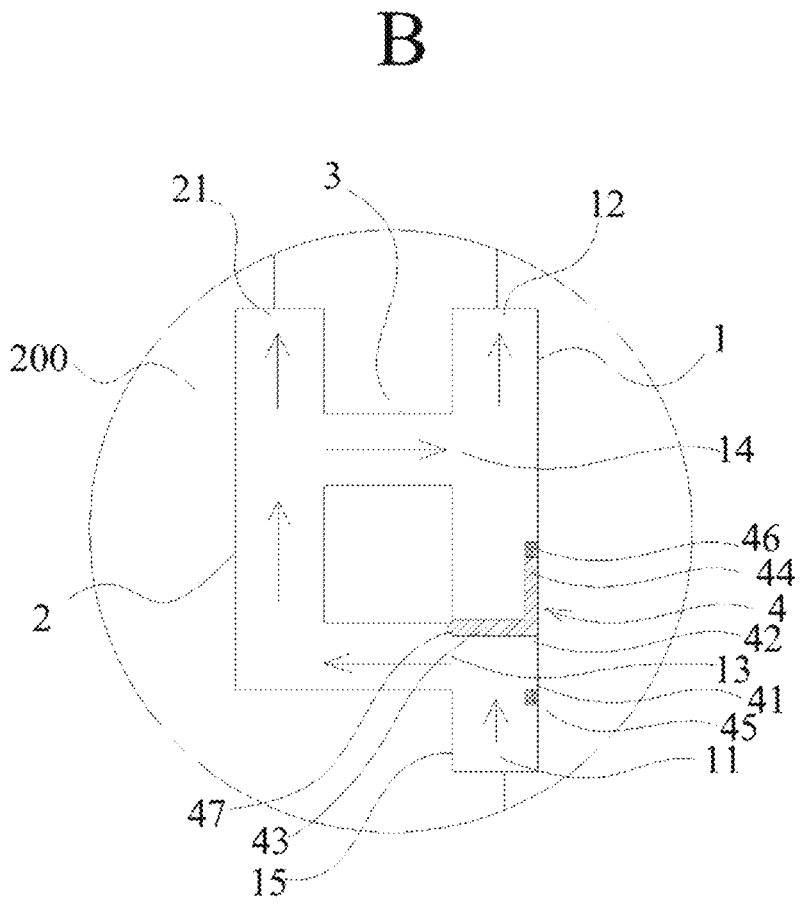
FIG. 3 is an enlarged schematic structure diagram of area B of FIG. 1.
Figure 9:
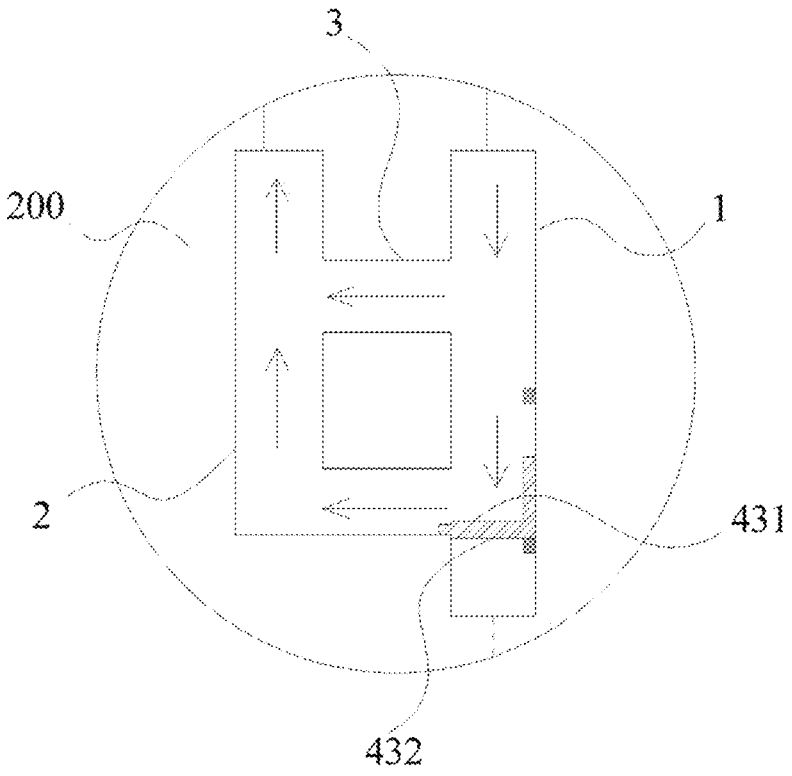
FIG. 9 is an enlarged schematic structure diagram of area D of FIG. 7.

As shown in FIGS. 1, 3, and 9, according to a first aspect of the embodiment of the present disclosure, a one-way diverting device is provided and comprises: a main pipe 1, a branch pipe 2, a connecting branch pipe 3, and a first sliding blocking member 4. The main pipe 1 comprises a first refrigerant pipe opening 11 and a second refrigerant pipe opening 12 at two ends of the main pipe 1, respectively, and the main pipe 1 is provided with a first distributing position 13 close to the first refrigerant pipe opening 11 and a second distributing position 14 close to the second refrigerant pipe opening 12. One end of the branch pipe 2 is connected to the first distributing position 13 of the main pipe 1, and the other end of the branch pipe 2 is a third refrigerant pipe opening 21. The connecting branch pipe 3 connects the second distributing position 14 of the main pipe 1 to the branch pipe 2. The first sliding blocking member 4 is slidably disposed at the first distributing position 13. In a case where the first sliding blocking member 4 slides to a first position 41, the first refrigerant pipe opening 11 is blocked, and the refrigerant flows in from the second refrigerant pipe opening 12 and flows out from the third refrigerant pipe opening 21; in a case where the first sliding blocking member 4 slides to a second position 42, the first refrigerant pipe opening 11 is conducted, and the refrigerant flows in from the first refrigerant pipe opening 11, and flows out from the second refrigerant pipe opening 12 and the third refrigerant pipe opening 21.

Adopting the one-way diverting device according to the embodiment of the present disclosure, comprising a main pipe 1, a branch pipe 2, a connecting branch pipe 3, and a first sliding blocking member 4. In a case where the first sliding blocking member 4 slides to the first position 41, the first refrigerant pipe opening 11 is blocked, and the refrigerant flows in from the second refrigerant pipe opening 12 and flows out from the third refrigerant pipe opening 21; and in a case where the first sliding blocking member 4 slides to the second position 42, the first refrigerant pipe opening 11 is conducted, and the refrigerant flows in from the first refrigerant pipe opening 11, and flows out from the second refrigerant pipe opening 12 and the third refrigerant pipe opening 21. The one-way diverting device doesn't need to be provided with redundant valves, the flow direction of the refrigerant inside the one-way diverting device can be changed by blocking or conducting the first refrigerant pipe opening 11 by the first sliding blocking member 4, reducing the material cost and the space cost.

In the embodiment of the present disclosure, the branch pipe 2 is connected to the first distributing position 13 of the main pipe 1, the connecting branch pipe 3 connects the second distributing position 14 of the main pipe 1 to the branch pipe 2, thus the inside of the one-way diverting device is connected as the shape of two concentric squares. It should be understood that, according to the above connection form of the branch pipe 2, the main pipe 1, and the connecting branch pipe 3, the inside of the one-way diverting device is not limited to the shape of two concentric squares, and it can be designed according to the actual requirement.

The operation principle of the one-way diverting device is as follows.

As shown in FIGS. 1 and 3, the straight lines with arrows show the flow direction of the refrigerant. In a case where the air conditioner is in the heating operation and the refrigerant inside the air conditioner pipe flows along the one-way diverting device, the refrigerant firstly flows in the first refrigerant pipe opening 11. Due to the refrigerant inside the air conditioner pipe having a certain flow velocity, the refrigerant flows in the first refrigerant pipe opening 11, and the flowing refrigerant pushes the first sliding blocking member 4 slides from the first position 41 to the second position 42. In a case where the first sliding blocking member 4 slides to the second position 42, the first refrigerant pipe opening 11 and the branch pipe 2 are conducted. Since the connecting branch pipe 3 connects the second distributing position 14 of the main pipe 1 and branch pipe 2, the refrigerant flows out from the second refrigerant pipe opening 12 of the main pipe 1 and the third refrigerant pipe opening 21 of the other end of the branch pipe 2.

Figure 7:
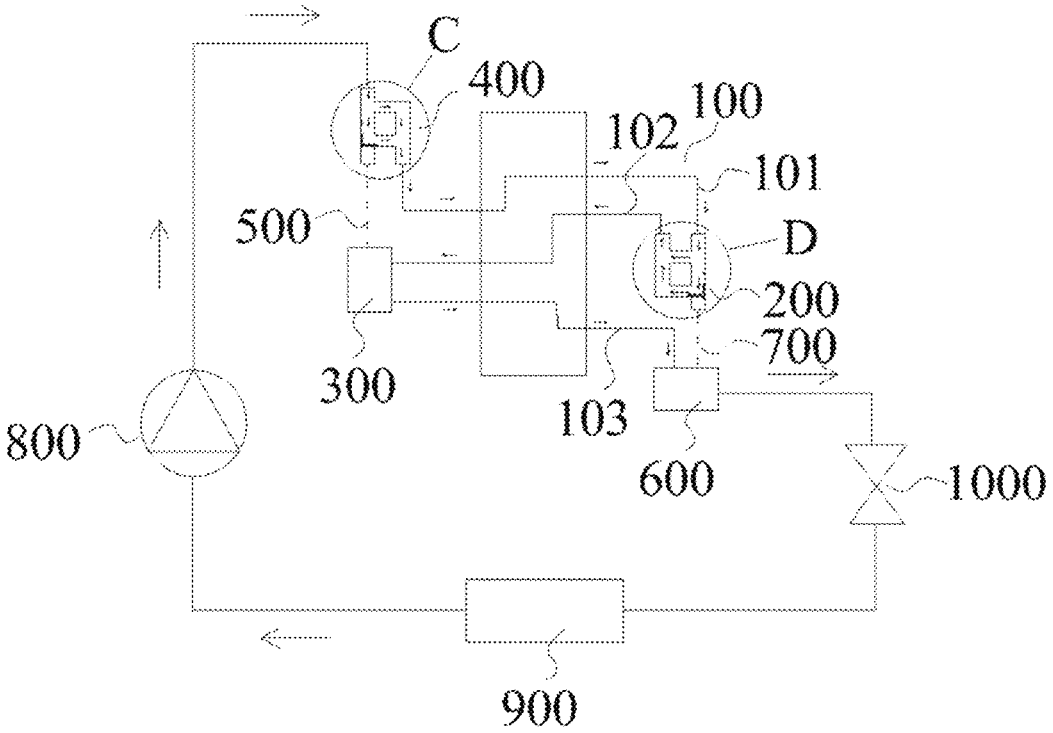
FIG. 7 is a schematic structure diagram of a variable diverting heat exchanger in the cooling operation according to the embodiment of the present disclosure.

As shown in FIGS. 7 and 9, in a case where the air conditioner is in the cooling operation and the refrigerant inside the air conditioner pipe flows along the one-way diverting device, the refrigerant firstly flows in the second refrigerant pipe opening 12. Due to the refrigerant inside the air conditioner pipe having a certain flow velocity, the refrigerant flows in the second refrigerant pipe opening 12, and the flowing refrigerant pushes the first sliding blocking member 4 slides from the second position 42 to the first position 41. In a case where the first sliding blocking member 4 slides to the first position 41, the first refrigerant pipe opening 11 is blocked. Since the first distributing position 13 of the main pipe 1 and branch pipe 2 are connected, and the second distributing position 14 of the main pipe 1 and the branch pipe 2 are connected by the connecting branch pipe 3, the refrigerant flows out from the third refrigerant pipe opening 21 of the branch pipe 2.

In some optional embodiments, as shown in FIG. 3, the first sliding blocking member 4 comprises: a first blocking slider 43, a first abutting slider 44, a first locating member 45, and a second locating member 46. The first blocking slider 43 is disposed along a cross-section of the first distributing position 13 of the main pipe 1, and is slidable between the first position 41 of the first distributing position 13 and the second position 42 of the first distributing position 13. The first blocking slider 44 is fixedly connected to the first blocking slider 43 and abuts against the inner side wall of the main pipe 1, and the first abutting slider 44 is slidable along with the first blocking slider 43. The first locating member 45 is disposed at the inner side wall of the main pipe 1. In a case where the first sliding blocking member 4 slides to the first position 41, the first blocking slider 43 abuts against the first locating member 45. The second locating member 46 is disposed at the inner side wall of the main pipe 1. In a case where the first sliding blocking member 4 slides to the second position 42, the first abutting slider 44 buts against the second locating member 46.

Adopting the optional embodiments, the first locating member 45 and the second locating member 46 are disposed at the inner side wall of the main pipe 1. In a case where the first sliding blocking member 4 slides to the first position 41, the first blocking slider 43 abuts against the first locating member 45; and in a case where the first sliding blocking member 4 slides to the second position 42, the first blocking slider 44 abuts against the second locating member 46. This is, the first blocking slider 43 and the first abutting slider 44 are limited by the first locating member 45 and the second locating member 46 respectively while sliding between the first position 41 and the second position 42, so as to realize the conduction and blocking between the first refrigerant pipe opening 11 and the branch pipe 2, with simple in structure, reasonable in design and convenient in processing and manufacturing.

In some optional embodiments, an inside of the first blocking slider 43 is hollow or partly hollow.

Adopting the optional embodiments, the inside of the first blocking slider 43 is hollow or partly hollow, reducing the weight of the first blocking slider 43 and reducing the resistance of the slide of the first blocking slider 43 pushed by refrigerant between the first position 41 and the second position 42.

Optionally, the material of the first blocking slider 43 can be a composite of one or more nylon, plastics, or metallic materials. In a case where the material of the first blocking slider 43 is metallic, the material can be aluminum, copper, steel, and so on.

It should be understood that, in a case where the weight of the first blocking slider 43 does not affect the push of the refrigerant, the first blocking slider 43 can be made of solid material to reduce the possibility of deformation.

Figure 4:
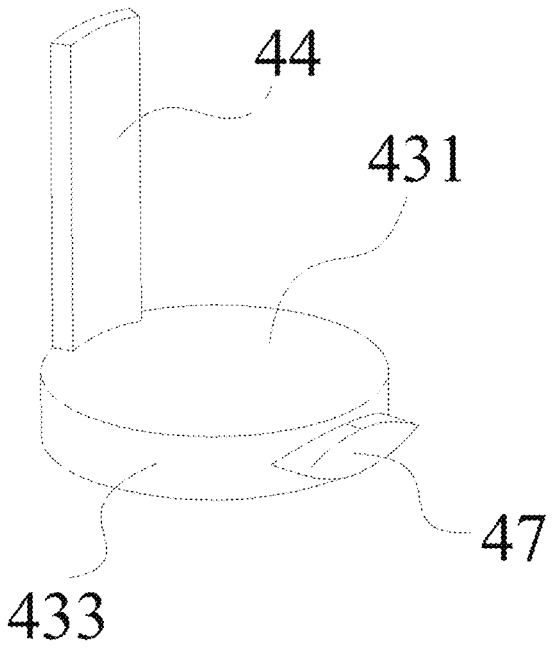
FIG. 4 is a partial schematic structure diagram of a first sliding blocking member according to the embodiment of the present disclosure.
Figure 5:
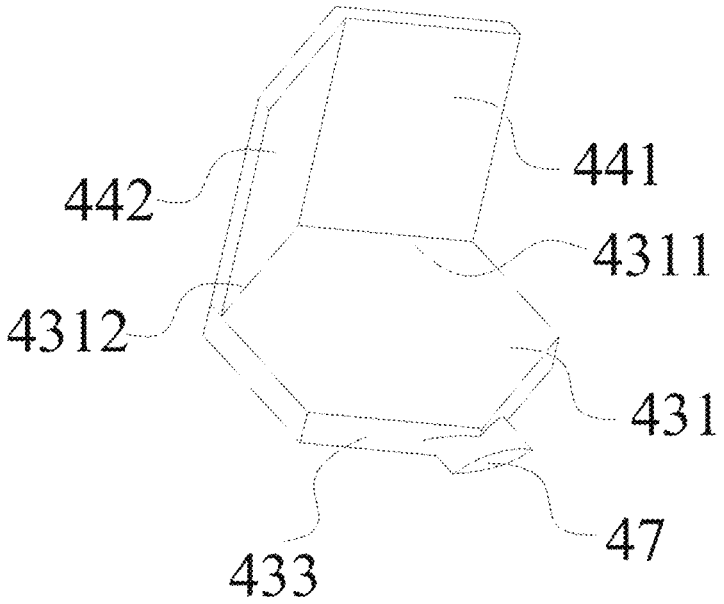
FIG. 5 is a partial schematic structure diagram of another first sliding blocking member according to the embodiment of the present disclosure.

In some optional embodiments, as shown in FIGS. 4, 5, and 9, the first blocking slider 43 comprises: a first bottom surface 431, a second bottom surface 432, and a first side surface 433. The first bottom surface 431 faces the inside of the main pipe 1. The second bottom surface 432 faces the first refrigerant pipe opening 11. The first side surface 433 is disposed surrounding between the first bottom surface 431 and the second bottom surface 432. The first abutting slider 44 is disposed along a periphery of the first bottom surface 431, a perimeter of the first bottom surface 431 has a first length, and an extended length of the first abutting slider 44 in the first bottom surface 431 has the second length. The second length is longer than or equal to ⅓ of the first length and shorter than or equal to ½ of the first length.

Adopting the optional embodiments, by setting the relationship between the first length and the second length as: the second length is longer than or equal to ⅓ of the first length and shorter than or equal to ½ of the first length, thus the contact area between the first abutting slider 44 and the inner side wall of the main pipe 1 in a suitable range, improving the stability of the first sliding blocking member 4.

Optionally, in a case where the first abutting slider 44 is vertical to the first bottom surface 431, the extended length of the first abutting slider 44 is in the first bottom surface 431, this is the second length, can be understood as the perimeter of a projection section of the first abutting slider 44 on the first bottom surface 431.

In some optional embodiments, the distance between the first side surface 433 of the first blocking slider 43 and the inner side wall of the main pipe 1 at the first distributing position 13 is larger than or equal to 0.005 mm, and smaller than or equal to 1 mm.

Adopting the optional embodiments, the distance between the first side surface 433 of the first blocking slider 43 and the inner side wall of the main pipe 1 at the first distributing position 13 is larger than or equal to 0.005 mm, and smaller than or equal to 1 mm, thus satisfying the small matching distance between the first blocking slider 43 and the inner side wall of the main pipe 1 at the first distributing position 13, improving the stability of the sliding of the first blocking slider 43 and not affecting the sliding of the first blocking slider.

Preferably, the distance between the first side surface 433 of the first blocking slider 43 and the inner side wall of the main pipe 1 at the first distributing position 13 is larger than or equal to 0.01 mm, and smaller than or equal to 0.02 mm.

In some optional embodiments, as shown in FIG. 5, the cross-section of the first distributing position 13 of the main pipe 1 is a polygon, and the first blocking slider 43 is shaped as same as the cross-section of the first distributing position 13.

Adopting the optional embodiments, the first blocking slider 43 is shaped as same as the cross-section of the first distributing position 13 and are both polygons, thus the first blocking slider 43 can be locked inside the main pipe 1, and in a case where the first blocking slider 43 slides back and forth at the first distributing position 13 of the main pipe 1, the first blocking slider is hard to rotate and improving the stability of sliding of the first blocking slider 43.

It should be understood that, the first blocking slider 43 and the cross-section of the first distributing position 13 of the main pipe 1 can also both be a circle, as shown in FIG. 4. Of course, the first blocking slider 43 and the cross-section of the first distributing position 13 of the main pipe 1 can be designed to other shapes according to the actual requirement.

In some optional embodiments, as shown in FIG. 5, the first bottom surface 431 of the first blocking slider 43 comprises a first edge 4311 and a second edge 4312 bending connected, where the first abutting slider 44 comprises a first abutting plate 441 and a second abutting plate 442 bending connected, the first abutting plate 441 is fixedly connected to the first edge 4311, and the second abutting plate 442 is fixedly connected to the second edge 4312.

Adopting the optional embodiments, the first bottom surface 431 of the first blocking slider 43 comprises the first edge 4311 and the second edge 4312 bending connected, the first abutting slider 44 comprises the first abutting plate 441 and the second abutting plate 442, the first abutting plate 441 is fixedly connected to the first edge 4311, and the second abutting plate 442 is fixedly connected to the second edge 4312. Thus, a contact angle is formed between the first abutting slider 44 and the inner side wall of the main pipe 1 at the first distributing position 13. On one hand, the contact area of the first abutting slider 44 with the inner side wall surface can be increased, and the structural stability of the first abutting slider 44 can be improved; on the other hand, the rotating while sliding of the first blocking slider 43 can be prevented.

In some optional embodiments, as shown in FIGS. 3, 4, and 5, the first sliding blocking member 4 further comprises a first protrusion 47, the first protrusion 47 is disposed at the first side surface 433 of the first blocking slider 43, and a height of the first protrusion is less than or equal to a height of the first side surface, where the first protrusion 47 is disposed at the side of the first sliding blocking member 4 facing the first distributing position 13, and the first abutting slider 44 is disposed at a side of the first sliding blocking member 4 away from the first distributing position 13.

Adopting the optional embodiments, the first protrusion 47 is disposed at the first side surface 433 of the first blocking slider 43 and the height of the first protrusion 47 is less than or equal to the height of the first side surface 433, and disposed at the side of the first sliding blocking member 4 facing the first distributing position 13. On one hand, the possibility of displacement of the first sliding blocking member 4 sliding to the first position 41 or the second position 42 is reduced; on the other hand, the first blocking slider 43 is supported, reducing the possibility of deformation due to the refrigerant impact.

It should be understood that, the shapes of the upper and lower surfaces of the first protrusion 47 are adapted to the shape of branch pipe 2 connecting the main pipe 1 of the first distributing position 13.

Figure 6:
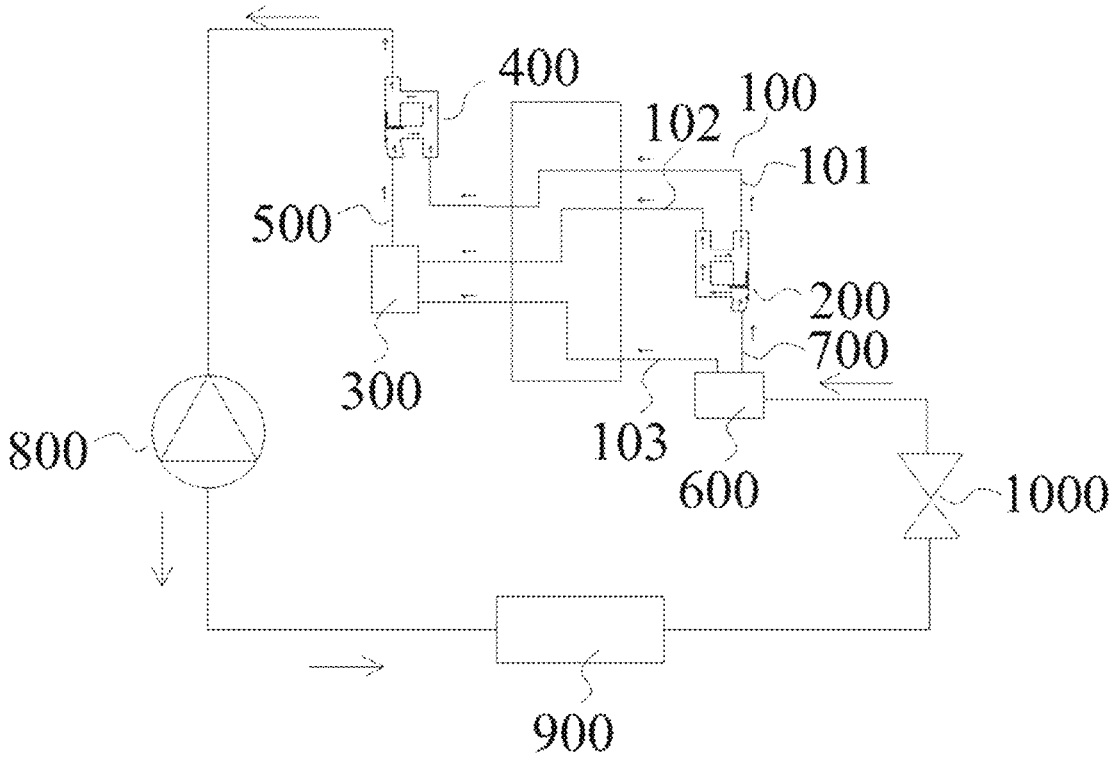
FIG. 6 is a schematic structure diagram of another variable diverting heat exchanger in the heating operation according to the embodiment of the present disclosure.

In some optional embodiments, the main pipe 1 comprises a first pipe section 15 between the first refrigerant pipe opening 11 and the first distributing position 13, where the first pipe section 15 is inclinedly disposed facing the first distributing position 13. As shown in FIG. 6, the first pipe section 15 is inclined from the lower left toward the upper right.

Adopting the optional embodiments, the first pipe section 15 is inclinedly disposed facing the first distributing position 13, thus, in the case where the refrigerant flows in from the first refrigerant pipe opening 11, the impact towards the upper right is formed on the first blocking slider 43 from the refrigerant, and the first blocking slider 43 and the first abutting slider 44 are tightly attached at the inner side wall of the main pipe 1 sliding from the first position 41 to the second position 42, ensuring the normal operating of first sliding blocking member 4.

Figure 2:
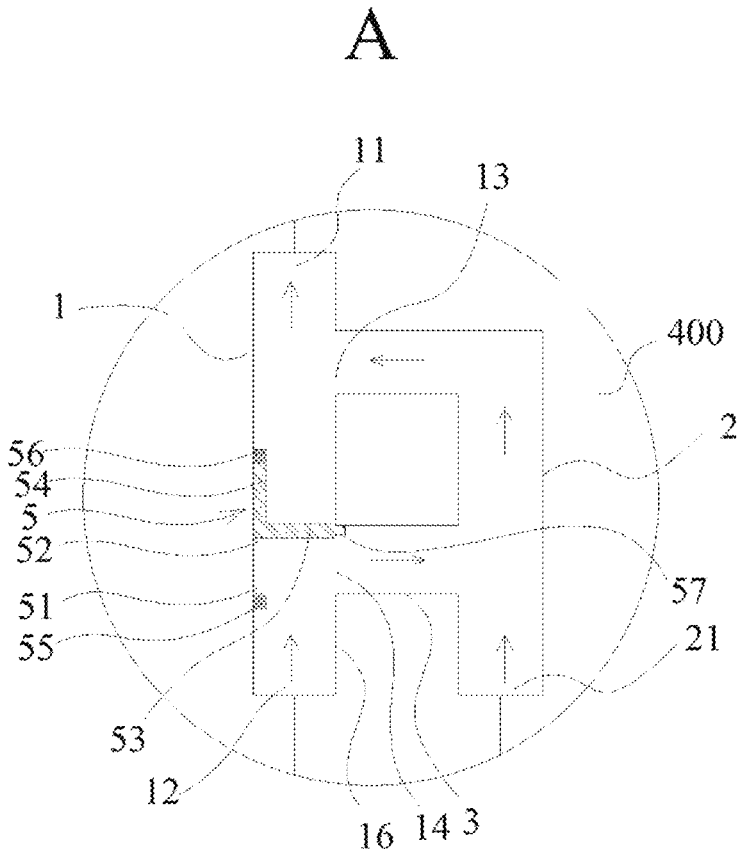
FIG. 2 is an enlarged schematic structure diagram of area A of FIG. 1.
Figure 8:
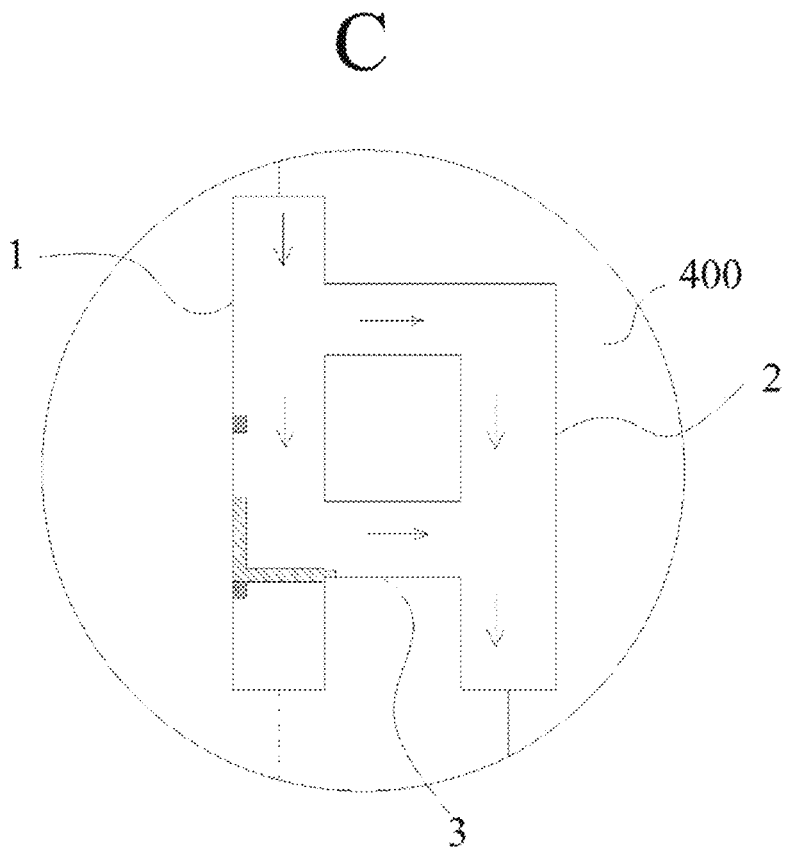
FIG. 8 is an enlarged schematic structure diagram of area C of FIG. 7.

As shown in FIGS. 1, 2, and 8, according to a second aspect of the embodiments of the present disclosure, a one-way diverting device is provided and comprises: a main pipe 1, a branch pipe 2, a connecting branch pipe 3, and a second sliding blocking member 5. The main pipe 1 comprises a first refrigerant pipe opening 11 and a second refrigerant pipe openings 12 at two ends of the main pipe 1, respectively, and the main pipe 1 is provided with a first distributing position 13 close to the first refrigerant pipe opening 11 and a second distributing position 14 close to the second refrigerant pipe opening 12. One end of the branch pipe 2 is connected to the first distributing position 13 of the main pipe 1, and the other end of the branch pipe 2 is a third refrigerant pipe opening 21. The connecting branch pipe 3 connects the second distributing position 14 of the main pipe 1 to the branch pipe 2. The second sliding blocking member 5 is slidably disposed at the second distributing position 14. In a case where the second sliding blocking member 5 slides to the third position 51, the second refrigerant pipe opening 12 is blocked, and the refrigerant flows in from the first refrigerant pipe opening 11 and flows out from the third refrigerant pipe opening 21; in a case where the second sliding blocking member 5 slides to the fourth position 52, the second refrigerant pipe opening 12 is conducted, and the refrigerant flows in from the second refrigerant pipe opening 12 and the third refrigerant pipe opening 21, and flows out from the first refrigerant pipe opening 11.

Adopting the one-way diverting device according to the embodiment of the present disclosure, the one-way diverting device comprises a main pipe 1, a branch pipe 2, a connecting branch pipe 3, and a second sliding blocking member 5. In a case where the second sliding blocking member 5 slides to the third position 51, the second refrigerant pipe opening 12 is blocked, and the refrigerant flows in the first refrigerant pipe opening 11 and flows out from the third refrigerant pipe opening 21; in a case where the second sliding blocking element 5 slides to the fourth position 52, the second refrigerant pipe opening 12 is conducted, and the refrigerant flows in from the second refrigerant pipe opening 12 and the third refrigerant pipe opening 21, and flows out from the first refrigerant pipe opening 11. The one-way diverting device doesn't need to be provided with redundant valves, the flow direction of the refrigerant inside the one-way diverting device can be changed by blocking or conducting the first refrigerant pipe opening 12 by the second sliding blocking member 5, reducing the material cost and the space cost.

In the embodiment of the present disclosure, the branch pipe 2 is connected to the first distributing position 13 of the main pipe 1, the connecting branch pipe 3 connects the second distributing position 14 of the main pipe 1 to the branch pipe 2, thus the inside of the one-way diverting device is connected as a shape of two concentric squares. It should be understood that, according to the above connection form of the branch pipe 2, the main pipe 1, and the connecting branch pipe 3, the inside of the one-way diverting device is not limited to the shape of two concentric squares, and it can be designed according to the actual requirement.

The operation principle of the one-way diverting device is as follows.

As shown in FIGS. 1 and 2, the straight lines with arrows show the flow direction of the refrigerant. In a case where the air conditioner is in the heating operation and the refrigerant inside the air conditioner pipe flows along the one-way diverting device, the refrigerant firstly flows in the second refrigerant pipe opening 12 and the third refrigerant pipe opening 21. Due to the refrigerant inside the air conditioner pipe having a certain flow velocity, the refrigerant flows in the third refrigerant pipe opening 12, and the flowing refrigerant pushes the second sliding blocking member 5 slides from the third position 51 to the fourth position 52. In a case where the second sliding blocking member 5 slides to the fourth position 52, the second refrigerant pipe opening 12 and the connecting branch pipe 3 are conducted, and due the branch pipe 2 connects to the first distributing position 13 of the main pipe 1, the refrigerant flows in from the second refrigerant pipe opening 12 and the third refrigerant pipe opening 21, and flows out from the first distributing position 11.

As shown in FIGS. 7 and 8, in a case where the air conditioner is in the cooling operation and the refrigerant inside the air conditioner pipe flows along the one-way diverting device, the refrigerant firstly flows in the first refrigerant pipe opening 11. Due to the refrigerant inside the air conditioner pipe having a certain flow velocity, the refrigerant flows in the first refrigerant pipe opening 11, and the flowing refrigerant pushes the second sliding blocking member 5 slides from the fourth position 52 to the third position 51. In a case where the second sliding blocking member 5 slides to the third position 51, the second refrigerant pipe opening 12 is blocked, and the connecting branch pipe 3 connects the second distributing position 14 of the main pipe 1 to the branch pipe 2, thus the refrigerant flows out from the third refrigerant pipe opening 21 of the branch pipe 2.

In some optional embodiments, as shown in FIG. 2, the second sliding blocking member 5 comprises: a second blocking slider 53, a second abutting slider 54, a third locating member 55, and a fourth locating member 56. The second blocking slider 53 is disposed along a cross-section of the second distributing position 14 of the main pipe 1, and the second blocking slider 53 is slidable between the third position 51 of the second distributing position 14 and the fourth position 52 of the second distributing position 14. The second blocking slider 54 is fixedly connected to the second blocking slider 53 and abuts against the inner side wall of the main pipe 1, and the second abutting slider 54 is slidable along with the second blocking slider 53. The third locating member 55 is disposed at the inner side wall of the main pipe 1. In a case where the second sliding blocking member 5 slides to the third position 51, the second blocking slider abuts against the third locating member 55. The fourth locating member 56 is disposed at the inner side wall of the main pipe 1. In a case where the second sliding blocking member 5 slides to the fourth position 52, the second abutting slider 54 buts against the fourth locating member 56.

Adopting the optional embodiments, the third locating member 55 and the fourth locating member 56 are disposed at the inner side wall of the main pipe 1. In a case where the second sliding blocking member 5 slides to the third position 51, the second blocking slider 53 abuts against the third locating member 55. In a case where the second sliding blocking member 5 slides to the fourth position 52, the second abutting slider 54 abuts against the fourth locating member 56. This is, the second blocking slider 53 and the second abutting slider 54 are limited by the third locating member 55 and the fourth locating member 56 respectively while sliding between the third position 51 and the fourth position 52, so as to realize the conduction and blocking between the second refrigerant pipe opening 12 and the connecting branch pipe 3, with simple in structure, reasonable in design and convenient in processing and manufacturing.

In some optional embodiments, an inside of the second blocking slider 53 is hollow or partly hollow.

Adopting the optional embodiments, the inside of the second blocking slider 53 is hollow or partly hollow, reducing the weight of the second blocking slider 53, and reducing the resistance of slide of the second blocking slider 53 pushed by refrigerant between the third position 51 and the fourth position 52.

Optionally, the material of the second blocking slider 53 can be a composite of one or more nylon, plastics, or metallic materials. In a case where the material of the second blocking slider 53 is metallic, the material can be aluminum, copper, steel, and so on.

It should be understood that, in a case where the weight of the second blocking slider 53 does not affect the push of the refrigerant, the second blocking slider 53 can be made of solid material to reduce the possibility of deformation.

In some optional embodiments, the second blocking slider 53 comprises: a third bottom surface, a fourth bottom surface, and a second surface. The third bottom surface faces the inside of the main pipe 1. The fourth bottom surface faces the second refrigerant pipe opening 12. The second side surface is disposed surrounding between the third bottom surface and the fourth bottom surface. Where the second abutting slider 54 is disposed along a periphery of the third bottom surface, a perimeter of the third bottom surface has a third length, and an extended length of the second abutting slider 54 in the third bottom surface has a fourth length, where the fourth length is longer than or equal to ⅓ of the second length, and shorter than or equal to ½ of the third length.

Adopting the optional embodiments, by setting the relationship between the third length and the fourth length as: the fourth length is longer than or equal to ⅓ of the third length and shorter than or equal to ½ of the third length, thus the contact area between the second abutting slider 54 and the inner side wall of the main pipe 1 in a suitable range, improving the stability of the second sliding blocking member 5.

Optionally, in a case where the second abutting slider 54 is vertical to the third bottom surface, the extended length of the second abutting slider 54 in the third bottom surface, this is the fourth length, can be understood as the perimeter of a projection section of the second abutting slider 54 on the third bottom surface.

In some optional embodiments, the distance between the second side surface of the second blocking slider 53 and the inner side wall of the main pipe 1 at the second distributing position 14 is larger than or equal to 0.005 mm, and smaller than or equal to 1 mm.

Adopting the optional embodiments, the distance between the second side surface of the second blocking slider 53 and the inner side wall of the main pipe 1 at the second distributing position 14 is larger than or equal to 0.005 mm, and smaller than or equal to 1 mm, thus satisfying the small matching distance between the third blocking slider 53 and the inner side wall of the main pipe 1 at the second distributing position 14, and not affects the sliding of the second blocking slider 53.

Preferably, the distance between the second side surface of the second blocking slider 53 and the inner side wall of the main pipe 1 at the second distributing position 14 is larger than or equal to 0.01 mm, and smaller than or equal to 0.02 mm.

In some optional embodiments, the cross-section of the second distributing position 14 of the main pipe 1 is a polygon, and the second blocking slider 53 is shaped as same as the cross-section of the second distributing position 14.

Adopting the optional embodiments, the second blocking slider 53 is shaped as same as the shape of the cross-section of the second distributing position 14 of the main pipe 1 and are both polygons, thus the second blocking slider 53 can be locked inside the main pipe 1, and in a case where the second blocking slider 53 slides back and forth at the second distributing position 14 of the main pipe 1, the second blocking slider 53 is hard to rotate, improving the stability of sliding of the second blocking slider 53.

It should be understood that, the second blocking slider 53 and the cross-section of the second distributing position 14 of the main pipe 1 can also both be a circle. Of course, the second blocking slider 53 and the cross-section of the second distributing position 14 of the main pipe 1 can be designed to other shapes according to the actual requirement.

In some optional embodiments, the third bottom surface of the second blocking slider 53 comprises a third edge and a fourth edge bending connected, where a second abutting slider 54 comprises a third abutting plate and a fourth abutting plate bending connected, where the third abutting plate is fixedly connected to the third edge, and the fourth abutting plate is fixedly connected to the fourth edge.

Adopting the optional embodiments, the third bottom surface of the second blocking slider 53 comprises the third edge and the fourth edge bending connected, the second abutting slider 54 comprises the third abutting plate and the fourth abutting plate bending connected, the third abutting plate is fixedly connected to the third edge, and the fourth abutting plate is fixedly connected to the fourth edge; thus a contact angle is formed between the second abutting slider 54 and the inner side wall of the main pipe 1 at the second distributing position 14. On one hand, the contact area of the second abutting slider 54 with the inner side wall surface can be increased, and the structural stability of the second abutting slider 54 can be improved; on the other hand, the rotating while sliding of the second blocking slider 53 can be prevented.

In some optional embodiments, as shown in FIGS. 1 and 2, the second sliding blocking member 5 further comprises a second protrusion 57, the second protrusion 57 is disposed at the second side surface of the first blocking slider 53, and a height of the second protrusion is less than or equal to a height of the second side surface, where the second protrusion 57 is disposed at the side of the second sliding blocking member 5 facing the second distributing position 14, and the second abutting slider 54 is disposed at the second sliding blocking member 5 away from the second distributing position 14.

Adopting the optional embodiments, the second protrusion 57 is disposed at the second side surface of the second blocking slider 53 and the height of the second protrusion is less than or equal to the height of the second side surface, and disposed at the side surface of the second sliding blocking member 5 facing the second distributing position 14. On one hand, the possibility of displacement of the second sliding blocking member 5 sliding to the third position 51 or the fourth position 52 is reduced. On the other hand, the second blocking slider 53 is supported, reducing the possibility of deformation due to the refrigerant impact.

It should be understood that, the shapes of the upper and lower surfaces of the second protrusion 57 are adapted to the inner side wall of the connecting branch pipe 3 connecting the main pipe 1 at the second distributing position 14.

In some optional embodiments, as shown in FIGS. 1,2, and 6, a main pipe 1 comprises a second pipe section 16 between the second refrigerant pipe opening 12 and the second distributing position 14, where the second pipe section 16 is inclinedly disposed facing the second distributing position 14.

Adopting the optional embodiments, the second pipe section 16 is inclinedly disposed facing the second distributing position 14, thus, in the case where the refrigerant flows in from the second refrigerant pipe opening 12, the impact towards the upper left is formed on the second blocking slider 53 from the refrigerant, the second blocking slider 53 and the second abutting slider 54 are tightly attached the inner side wall of the main pipe 1 sliding from the third position 51 to the fourth position 52, ensuring the normal operating of second sliding blocking member 5.

According to a third aspect of the embodiments of the present disclosure, a variable diverting heat exchanger is provided, as shown in FIGS. 1 and 7, the variable diverting heat exchanger comprises a heat exchange pipe 100, a first one-way diverting device 200, a first distributor 300, a second one-way diverting device 400, a first bypass pipe 500, a second distributor 600, and a second bypass pipe 700.

The heat exchange pipe 100 comprises a first heat exchange branch 101, a second heat exchange branch 102, and a third heat exchange branch 103 in parallel connection. The first one-way diverting device 200 is disposed at a first side of the heat exchange pipe 100, and the second refrigerant pipe opening 12 of the first one-way diverting device 200 is connected to the first heat exchange branch 101. The first distributor 300 is disposed at a second side of the heat exchange pipe 100, and the first distributor 300 is connected to the second heat exchange branch 102 and the third heat exchange branch 103. The second one-way diverting device 400 is disposed at the second side of the heat exchange pipe 100, and the third refrigerant pipe opening 21 of the second one-way diverting device 400 is connected to the first heat exchange branch 101. The first bypass pipe 500 connects the second refrigerant pipe opening 12 of the second one-way diverting device 400 with the first distributor 300. The second distributor 600 is disposed at the first side of the heat exchange pipe 100, and the second distributor 600 is connected to the third heat exchange branch 103. The second bypass pipe 700 connects the first refrigerant pipe opening 11 of the first one-way diverting device with the second distributor 600.

As shown in FIGS. 3 and 9, the first one-way diverting device 200 is a one-way diverting device in the first aspect of the embodiments. As shown in FIGS. 2 and 8, the second one-way diverting device 400 is a one-way diverting device in the second aspect of the embodiments.

The variable diverting heat exchanger is provided according to the embodiment of the present disclosure and comprises the first one-way diverting device according to the first aspects of any one of the embodiments and the one-way diverting device according to the second aspect of any one of the embodiments, therefore the variable diverting heat exchanger has the beneficial effects of the one-way diverting device according to the first aspect of any one of the embodiments and the one-way diverting device according to the second aspect of any one of the embodiments, and not repeatedly described herein.

As shown in FIGS. 1 and 7, an air conditioner comprises a compressor 800, an indoor heat exchanger 900, a throttle device 1000, a variable diverting heat exchanger, and a refrigerant circulation circuit thereof.

In a case where the air conditioner is in the heating operation, the flow direction of the refrigerant is shown by the straight lines with arrows in FIG. 1. Specifically, the refrigerant in high-temperature and high-pressure from the compressor 800 flows in the indoor heat exchanger 900, the indoor heat exchanger 900 heats the indoor environment under the action of the fan. The cooled refrigerant flows into the throttle device 1000, and after the throttling and depressurization process of the throttle device 1000, the refrigerant flows into the variable diverting heat exchanger. Specifically, the refrigerant firstly flows in the second distributor 600 of the variable diverting heat exchanger, then a part of the refrigerant flows in the third heat exchange branch 103 from the second distributor 600, the other part of the refrigerant flows in the first refrigerant pipe opening 11 of the first one-way diverting device 200 through the second bypass pipe 700, and then the refrigerant from the second refrigerant pipe opening 12 and the third refrigerant pipe opening 21 of the first one-way diverting device 200 flow in the first heat exchange branch 101 and the second heat exchange branch 102 respectively. The refrigerant from the second heat exchange branch 102 and the third heat exchange branch 103 flows in the first distributor 300. The refrigerant flowing in the first distributor 300 through the first bypass pipe 500 flows in the second refrigerant pipe opening 12 of the second one-way diverting device 400, the refrigerant flowing out from the first heat exchange branch 101 flows in from the third refrigerant pipe opening 21 of the second one-way diverting device 400, thus all of the refrigerant flows out the first refrigerant pipe opening 11 of the second one-way diverting device 400 and flows back to the compressor 800 for the next circulation. In the above process, the first heat exchange branch 101, the second heat exchange branch 102, and the third heat exchange branch 103 are connected in parallel. This is, the refrigerant finishes heat exchange in a variable diverting heat exchanger body through three branches, ensuring the heat transfer coefficient and greatly reducing the pressure drop, thus improving the low-temperature heating production.

In a case where the air conditioner is in the cooling operation, the flow direction of the refrigerant is shown by the straight lines with arrows in FIG. 7. Specifically, the refrigerant in high-temperature and high-pressure form the compressor 800 flows into the variable diverting heat exchanger. Specifically, the refrigerant firstly flows in the first refrigerant pipe opening 11 of the second one-way diverting device 400 of the variable diverting heat exchanger and then flows out from the third refrigerant pipe opening 21 of the second one-way diverting device 400. The refrigerant flowing out from the first heat exchange branch 101 flows in the second refrigerant pipe opening 12 of the first one-way diverting device 200 and flows out from the third refrigerant pipe opening 21 of the first one-way diverting device 200. The flowing out refrigerant flows in the second heat exchange branch 102, the first distributor 300, and the third heat exchange branch 103 in turn, and then flows in the second distributor 600 from the third heat exchange branch 103. After refrigerant flows out from the second distributor 600, the refrigerant flows in the throttle device 1000 for throttling and depressurization and then flows in the indoor heat exchanger 900, the indoor heat exchanger 900 cools the indoor air. After absorbing the heat of the indoor environment, the refrigerant flows back to the compressor 800 for the next circulation. In the above process, the first heat exchange branch 101, the second heat exchange branch 102, and the third heat exchange branch 103 connect the second one-way diverting device 400, the first one-way diverting device 200, the first distributor 300, and the second distributor 600 in series. This is, the refrigerant completes heat exchange in variable diverting heat exchanger body flows through one path, accelerating the circulation of the refrigerant and increasing the high-temperature cooling production.

The above description and drawings sufficiently illustrate embodiments of the present disclosure to enable practice by those skilled in the art. Other embodiments may comprise structural and other modifications. Embodiments represent only possible variations. Unless explicitly required, individual parts and functions are optional, and the order of operation can vary. Portions and features of some embodiments may be included in or in place of portions and features of other embodiments. Embodiments of the present disclosure are not limited to the structures already described above and shown in the figures and are subject to various modifications and changes without departing from their scope. The scope of the present invention is defined by the attached claims.

What is claimed is:

1. A one-way diverting device, comprising:

a main pipe, comprising a first refrigerant pipe opening and a second refrigerant pipe opening disposed on two ends of the main pipe respectively, wherein the main pipe is provided with a first distributing position close to the first refrigerant pipe opening and a second distributing position close to the second refrigerant pipe opening;

a branch pipe, wherein one end of the branch pipe is connected to the first distributing position of the main pipe, and the other end of the branch pipe is a third refrigerant pipe opening;

a connecting branch pipe, connecting the second distributing position of the main pipe and the branch pipe; and a first sliding blocking member, slidably disposed at the first distributing position;

wherein in a case where the first sliding blocking member slides to a first position, the first refrigerant pipe opening is blocked, and a refrigerant flows in from the second refrigerant pipe opening and flows out from the third refrigerant pipe opening; and in case where the first sliding blocking member slides to a second position, the first refrigerant pipe opening is conducted, and the refrigerant flows in from the first refrigerant pipe opening and flows out from the second refrigerant pipe opening and the third refrigerant pipe opening.

2. The one-way diverting device according to claim 1, wherein the first sliding blocking member comprises:

a first blocking slider, disposed along a cross-section of the first distributing position of the main pipe, and slidable between the first position of the first distributing position and the second position of the first distributing position;

a first abutting slider, fixedly connected to the first blocking slider and abutting against an inner side wall of the main pipe, wherein the first abutting slider is slidable along with the first blocking slider;

a first locating member, disposed at the inner side wall of the main pipe; wherein in case where the first sliding blocking member slides to the first position, the first blocking slider abuts against the first locating member; and a second locating member, disposed at the inner side wall of the main pipe; wherein in case where the first sliding blocking member slides to the second position, the first abutting slider abuts against the second locating member.

3. The one-way diverting device according to claim 2, wherein an inside of the first blocking slider is hollow or partly hollow.

4. The one-way diverting device according to claim 2, wherein the first sliding blocking slider comprises:

a first bottom surface, facing an inside of the main pipe;

a second bottom surface, facing the first refrigerant pipe opening; and a first side surface, disposed surrounding between the first bottom surface and the second bottom surface;

wherein the first abutting slider is disposed along a periphery of the first bottom surface, a perimeter of the first bottom surface has a first length, and an extended length of the first abutting slider in the first bottom surface has a second length, and the second length is longer than or equal to ⅓ of the first length and shorter than or equal to ½ of the first length.

5. The one-way diverting device according to claim 4, wherein a distance between the first side surface of the first blocking slider and the inner side wall of the main pipe at the first distributing position is larger than or equal to 0.005 mm, and smaller than or equal to 1 mm.

6. The one-way diverting device according to claim 4, wherein the first sliding blocking member further comprises a first protrusion, disposed at the first side surface of the first blocking slider, and a height of the first protrusion is less than or equal to a height of the first side surface; and the first protrusion is disposed at a side of the first sliding blocking member facing the first distributing position, and the first abutting slider is disposed at a side of the first sliding blocking member away from the first distributing position.

7. The one-way diverting device according to claim 2, wherein the cross-section of the first distributing position of the main pipe is a polygon, and the first blocking slider is shaped as same as the cross-section of the first distributing position.

8. The one-way diverting device according to claim 7, wherein the first bottom surface of the first blocking slider comprises a first edge and a second edge bending connected; and the first abutting slider comprises a first abutting plate and a second abutting plate bending connected, the first abutting plate is fixedly connected to the first edge, and the second abutting plate is fixed connected to the second edge.

9. The one-way diverting device according to claim 2, wherein the main pipe comprises a first pipe section between the first refrigerant pipe opening and the first distributing position; and the first pipe section is inclinedly disposed facing the first distributing position.

10. A variable diverting heat exchanger, comprising:

a heat exchange pipe, comprising a first heat exchange branch, a second heat exchange branch, and a third heat exchange branch connected in parallel;

a first one-way diverting device, disposed at a first side of the heat exchange pipe, wherein a second refrigerant pipe opening of the first one-way diverting device is connected to the first heat exchange branch;

a first distributor, disposed at a second side of the heat exchange pipe, wherein the first distributor is connected to the second heat exchange branch and the third heat exchange branch;

a first bypass pipe, connecting the second refrigerant pipe opening of the second one-way diverting device and the first distributor;

a second distributor, disposed at the first side of the heat exchange pipe, wherein the second distributor is connected to the third heat exchange branch; and a second bypass pipe, connecting a first refrigerant pipe opening of the first one-way diverting device and the second distributor;

wherein the first one-way diverting device is the one-way diverting device according to claim 1.

11. A one-way diverting device, comprising:

a main pipe, comprising a first refrigerant pipe opening and a second refrigerant pipe opening disposed on two ends of the main pipe respectively, wherein the main pipe is provided with a first distributing position close to the first refrigerant pipe opening and a second distributing position close to the second refrigerant pipe opening;

a branch pipe, wherein one end of the branch pipe is connected to the first distributing position of the main pipe, and the other end of the branch pipe is a third refrigerant pipe opening;

a connecting branch pipe, connecting the second distributing position of the main pipe and the branch pipe; and a second sliding blocking member, slidably disposed at the second distributing position, wherein in case where the second sliding blocking member slides to a third position, the second refrigerant pipe opening is blocked, and a refrigerant flows in from the first refrigerant pipe opening and flows out from the third refrigerant pipe opening; and in case where the second sliding blocking member slides to a fourth position, the second refrigerant pipe opening is conducted, and the refrigerant flows in from the second refrigerant pipe opening and the third refrigerant pipe opening, and flows out from the first refrigerant pipe opening.

12. The one-way diverting device according to claim 11, wherein the second sliding blocking member comprises:

a second blocking slider, disposed along a cross-section of the second distributing position of the main pipe, and slidable between the third position of the second distributing position and the fourth position of the second distributing position;

a second abutting slider, fixedly connected to the second blocking slider and abutting against the inner side wall of the main pipe, wherein the second abutting slider is slidable along with the second blocking slider;

a third locating member, disposed at an inner side wall of the main pipe; wherein in case where the second sliding blocking member slides to the third position, the second blocking slider abuts against the third locating member; and a fourth locating member, disposed at the inner side wall of the main pipe; wherein in case where the second sliding blocking member slides to the fourth position, the second abutting slider abuts against the fourth locating member.

13. The one-way diverting device according to claim 12, wherein an inside of the second blocking slider is hollow or partly hollow.

14. The one-way diverting device according to claim 12, wherein the second sliding blocking member comprises:

a third bottom surface, facing an inside of the main pipe;

a fourth bottom surface, facing the second refrigerant pipe opening; and a second side surface, disposed surrounded between the third bottom surface and the fourth bottom surface, wherein the second abutting slider is disposed along a periphery of the third bottom surface, a perimeter of the third bottom surface has a third length, and an extended length of the second abutting slider in the third bottom surface has the fourth length, the fourth length is longer than or equal to ⅓ of the third length and shorter than or equal to ½ of the third length.

15. The one-way diverting device according to claim 14, wherein the distance between the second side surface of the second blocking slider and the inner side wall of the main pipe at the second distributing position is larger than or equal to 0.005 mm, and smaller than or equal to 1 mm.

16. The one-way diverting device according to claim 14, wherein the second sliding blocking member further comprises a second protrusion, disposed at the second side surface of the second blocking slider, and a height of the second protrusion is less than or equal to a height of the second side surface; and the second protrusion is disposed at a side of the second sliding blocking member facing the second distributing position, and the second abutting slider is disposed at the second sliding blocking member away from the second distributing position.

17. The one-way diverting device according to claim 12, wherein a cross-section of the second distributing position of the main pipe is a polygon, and the second blocking slider is shaped as same as the cross-section of the second distributing position.

18. The one-way diverting device according to claim 17, wherein the third bottom surface of the second blocking slider comprises a third edge and a fourth edge bending connected; and the second abutting slider comprises a third abutting plate and a fourth abutting plate bending connected, the third abutting plate is fixedly connected to the third edge, and the fourth abutting plate is fixed connected to the fourth edge.

19. The one-way diverting device according to claim 12, wherein the main pipe comprises a second pipe section between the second refrigerant pipe opening and the second distributing position; and the second pipe section is inclinedly disposed facing the second distributing position.

20. A variable diverting heat exchanger, comprising:

a heat exchange pipe, comprising a first heat exchange branch, a second heat exchange branch, and a third heat exchange branch connected in parallel;

a first distributor, disposed at a second side of the heat exchange pipe, wherein the first distributor is connected to the second heat exchange branch and the third heat exchange branch;

a second one-way diverting device, disposed at the second side of the heat exchange pipe, wherein a third refrigerant pipe opening of the second one-way diverting device is connected to the first heat exchange branch;

a first bypass pipe, connecting the second refrigerant pipe opening of the second one-way diverting device and the first distributor;

a second distributor, disposed at the first side of the heat exchange pipe, wherein the second distributor is connected to the third heat exchange branch; and a second bypass pipe, connecting a first refrigerant pipe opening of the first one-way diverting device and the second distributor;

wherein the second one-way diverting device is the one-way diverting device according to claim 11.

* * * * *